US008106869B2

(12) United States Patent
Feng

(10) Patent No.: US 8,106,869 B2
(45) Date of Patent: Jan. 31, 2012

(54) LIQUID CRYSTAL DISPLAY WITH COUPLING LINE FOR ADJUSTING COMMON VOLTAGE AND DRIVING METHOD THEREOF

(75) Inventor: Sha Feng, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 848 days.

(21) Appl. No.: 12/154,760

(22) Filed: May 27, 2008

(65) Prior Publication Data

US 2008/0291146 A1 Nov. 27, 2008

(30) Foreign Application Priority Data

May 25, 2007 (CN) ..... 2007 1 0074612

(51) Int. Cl.
*G09G 3/38* (2006.01)

(52) U.S. Cl. ..... 345/92

(58) Field of Classification Search ..... 345/58, 345/87–104, 204–206, 210, 212
See application file for complete search history.

(56) References Cited

U.S. PATENT DOCUMENTS

| | | | | |
|---|---|---|---|---|
| 6,201,522 | B1 * | 3/2001 | Erhart et al. | 345/96 |
| 6,392,626 | B1 | 5/2002 | Moon | |
| 6,677,925 | B1 * | 1/2004 | Kawaguchi et al. | 345/98 |
| 7,102,604 | B2 * | 9/2006 | Hong | 345/87 |
| 7,138,996 | B2 | 11/2006 | Lee et al. | |
| 7,859,496 | B2 * | 12/2010 | Kim et al. | 345/87 |
| 2005/0243045 | A1 * | 11/2005 | Kim | 345/87 |
| 2006/0187169 | A1 * | 8/2006 | Okuno | 345/98 |
| 2007/0085800 | A1 * | 4/2007 | Lee et al. | 345/94 |

FOREIGN PATENT DOCUMENTS

CN 1134696 C 1/2004

* cited by examiner

*Primary Examiner* — Chanh Nguyen
*Assistant Examiner* — James Nokham
(74) *Attorney, Agent, or Firm* — Altis Law Group, Inc.

(57) ABSTRACT

An exemplary liquid crystal display includes parallel data lines, a data driver configured for driving the data lines, a coupling line crossing the data lines, a common electrode layer, and a common voltage generator configured for applying common voltages to the common electrode layer. The common voltage generator is connected to the coupling line. When data driver applies a plurality of data signals to the data lines, the data signals generate an influence signal at the coupling line. The common voltage generator adjusts common voltages applied to the common electrode layer according to the influence signal. A related method for driving the liquid crystal display is also provided.

20 Claims, 7 Drawing Sheets

LIQUID CRYSTAL DISPLAY WITH COUPLING LINE FOR ADJUSTING COMMON VOLTAGE AND DRIVING METHOD THEREOF

CROSS-REFERENCE TO RELATED APPLICATION

This application is related to, and claims the benefit of, a foreign priority application filed in China as Application No. 200710074612.5 on May 25, 2007. The related application is incorporated herein by reference.

FIELD OF THE INVENTION

The present invention relates to a liquid crystal display (LCD) capable of suppressing crosstalk by adjusting a common voltage, and to a driving method for suppressing crosstalk of the LCD.

GENERAL BACKGROUND

A typical LCD has the advantages of portability, low power consumption, and low radiation. Therefore, the LCD has been widely used in various portable information products, such as notebooks, personal digital assistants (PDAs), video cameras, and the like. Furthermore, the LCD is considered by many to have the potential to completely replace cathode ray tube (CRT) monitors and televisions.

FIG. 8 is a schematic, side cross-sectional view of certain components of a typical LCD. The LCD 10 includes a color filter substrate 11, a thin film transistor (TFT) substrate 12 positioned generally opposite to the color filter substrate 11, a liquid crystal layer 13 sandwiched between the two substrates 11, 12, and a common electrode layer 15 located between the color filter substrate 11 and the liquid crystal layer 13.

Referring also to FIG. 9, this is a schematic, abbreviated diagram of certain components of a drive circuit of the LCD 10. The drive circuit 20 includes a plurality of data lines 23 that are parallel to each other and that each extend along a first direction, a plurality of gate lines 24 that are parallel to each other and that each extend along a second direction orthogonal to the first direction, a plurality of pixel units (not labeled) defined by the intersecting data lines 23 and gate lines 24, a data driver 21 configured for driving the data lines 23, and a gate driver 22 configured for driving the gate lines 24. The data lines 23 and the gate lines 24 are located at the TFT substrate 12 of the LCD 10.

Each pixel unit includes a TFT 25, a pixel electrode 26, and a pixel capacitor 27. A gate electrode (not labeled) of the TFT 25 is connected to a corresponding gate line 24. A source electrode (not labeled) of the TFT 25 is connected to a corresponding data line 23. A drain electrode (not labeled) of the TFT 25 is connected to the pixel electrode 26. One electrode (not labeled) of the pixel capacitor 27 is connected to the pixel electrode 26, and the other electrode (not labeled) of the pixel capacitor 27 is electrically connected to the common electrode layer 15.

Referring also to FIG. 10, this is an abbreviated timing chart illustrating operation of the gate driver 22 of the LCD 10. The gate driver 22 applies a plurality of gate signals G1-Gn to the gate lines 24. Each of the gate signals is a voltage pulse signal. During each frame time T1, one gate signal is applied to the gate lines 24, one by one in turn. That is, at any given time during the frame time T1, only one of the gate lines 24 has a gate signal applied thereto. The period of time that each gate line 24 has a gate signal applied thereto is defined as T2. During the time T2 when the corresponding gate line 24 has a gate signal applied thereto, the transistors 25 connected to the gate line 24 are turned on. The data driver 21 applies a plurality of data signals to the data lines 23. Each data signal is transmitted to the pixel electrode 26 via a corresponding turned-on TFT 25. Thereby, the corresponding pixel unit displays a gray level according to the data signal.

Referring also to FIG. 11, this is an abbreviated timing chart illustrating operation of the data driver 21 of the LCD 10. Line "Vd" (the solid line) represents a waveform output by the data driver 21 during the period T2. "Vcom1" (shown as the dashed line) represents the common voltage applied to the common electrode layer 15. "R", "G", "B" respectively represent data voltages of red (R), green (G), and blue (B) data signals corresponding to red, green, and blue pixel units. The data voltages of the red, green, and blue data signals have a positive polarity and a negative polarity relative to the common voltage Vcom1. In particular, if the data voltages of the red, green, and blue data signals are greater than the common voltage, the red, green, and blue data signals have a positive polarity. If the data voltages of the red, green, and blue data signals are less than the common voltage, the red, green, and blue data signals have a negative polarity. As indicated in FIG. 11, a total voltage value of the data signals having the positive polarity is less than a total voltage value of the data signals having the negative polarity.

Parasitic capacitors (not shown) exist between the pixel electrodes 26 and the common electrode layer 15. Data signals applied to the pixel electrodes 26 can influence the common voltage via the parasitic capacitors. For example, if the total voltage value of the data signals having the positive polarity is less than the total voltage value of the data signals having the negative polarity, the applied common voltage Vcom1 is pulled down to a reduced common voltage "Vcom2", as shown in FIG. 12. That is, the data voltages having the positive polarity are in effect increased in magnitude, and the data voltages having the negative polarity are in effect reduced in magnitude. This causes so-called crosstalk between the data lines 23 of the LCD 10.

What is needed, therefore, is a liquid crystal display that can overcome the above-described deficiencies, and a method for driving a liquid crystal display that can overcome the above-described deficiencies.

SUMMARY

In an exemplary embodiment, a liquid crystal display includes a plurality of data lines, a data driver configured for driving the data lines, a coupling line crossing the data lines, a common electrode layer, and a common voltage generator configured for applying common voltages to the common electrode layer. The common voltage generator is connected to the coupling line. When the data driver applies a plurality of data signals to the data lines, the data signals generate an influence signal at the coupling line. The common voltage generator adjusts the common voltages applied to the common electrode layer according to the influence signal.

Other novel features and advantages will become more apparent from the following detailed description when taken in conjunction with the accompanying drawings. In the drawings, all the views are schematic.

DETAILED DESCRIPTION OF PREFERRED EMBODIMENTS

Reference will now be made to the drawings to describe preferred and exemplary embodiments in detail.

Figure 1:
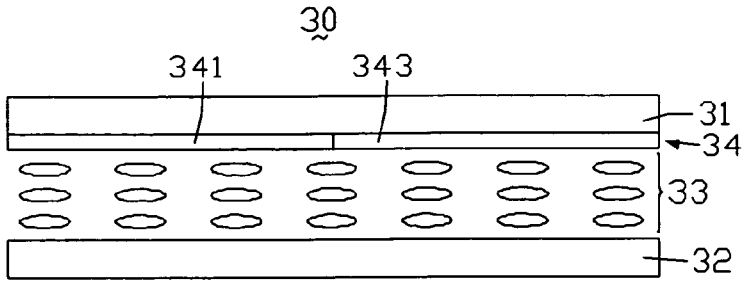
FIG. 1 is a side cross-sectional view of certain components of a liquid crystal display according to a first embodiment of the present invention, the liquid crystal display including a drive circuit (not visible).

FIG. 1 is a schematic, side cross-sectional view of certain components of an LCD 30 according to a first embodiment of the present invention. The LCD 30 includes a color filter substrate 31, a TFT substrate 32 positioned generally opposite to the color filter substrate 31, a liquid crystal layer 33 sandwiched between the two substrates 31, 32, and a common electrode layer 34 located between the color filter substrate 31 and the liquid crystal layer 33. The common electrode layer 34 is a transparent layer, and is made of indium tin oxide (ITO) or indium zinc oxide (IZO). In the illustrated embodiment, the common electrode layer 34 is divided into a first region 341 and a second region 343.

Figure 2:
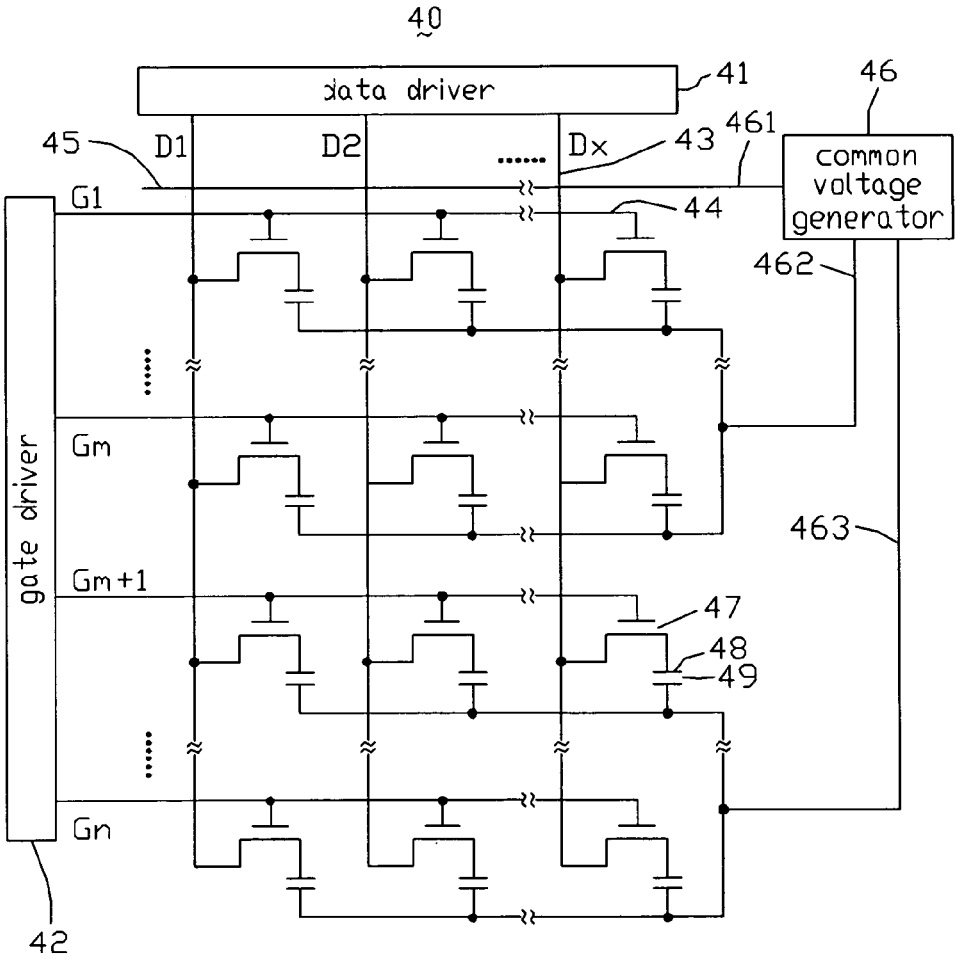
FIG. 2 is an abbreviated diagram of certain components of the drive circuit of the liquid crystal display of FIG. 1, the drive circuit including a common voltage generator.

Referring also to FIG. 2, this is a schematic, abbreviated diagram of certain components of a drive circuit 40 of the LCD 30. The drive circuit 40 includes a plurality of data lines 43 that are parallel to each other and that each extend along a first direction, a plurality of gate lines 44 that are parallel to each other and that each extend along a second direction orthogonal to the first direction, a plurality of pixel units (not labeled) defined by the intersecting data lines 43 and gate lines 44, a coupling line 45 parallel to the gate lines 44 and orthogonal to the data lines 43, a data driver 41 configured for driving the data lines 43, a gate driver 42 configured for driving the gate lines 44, and a common voltage generator 46. The data lines 43 and the gate lines 44 are located at the TFT substrate 32 of the LCD 30.

The gate lines 44 are divided into a first group (not labeled) and a second group (not labeled). The first and second groups of gate lines 44 respectively correspond to the first and second regions 341, 343 of the common electrode layer 34. In the illustrated embodiment, the gate lines 44 are successively labeled as G1, . . . Gm, Gm+1, . . . , Gn, where $1 \leqq m \leqq n-1$ and m and n are positive integers. The gate lines 44 labeled from G1 to Gm are defined as the first group, and the gate lines 44 labeled from Gm+1 to Gn are defined as the second group. The coupling line 45 is located at the TFT substrate 32, between the gate lines 44 and the data driver 41. Each of the data lines 43 and the coupling line 45 define a coupling capacitor (not shown) therebetween.

The common voltage generator 46 includes a first input terminal 461, a first output terminal 462, and a second output terminal 463. One terminal of the coupling line 45 is grounded. The other terminal of the coupling line 45 is connected to the first input terminal 461 of the common voltage generator 46. The first output terminal 462 of the common voltage generator 46 is electrically connected to the first region 341 of the common electrode layer 34. The second output terminal 463 of the common voltage generator 46 is electrically connected to the second region 343 of the common electrode layer 34. Thereby, the common voltage generator 46 applies common voltages to the first and the second regions 341, 343 of the common electrode layer 34, respectively.

Each pixel unit includes a TFT 47, a pixel electrode 48, and a pixel capacitor 49. A gate electrode (not labeled) of the TFT 47 is connected to a corresponding gate line 44. A source electrode (not labeled) of the TFT 47 is connected to a corresponding data line 43. A drain electrode (not labeled) of the TFT 47 is connected to the pixel electrode 48. When the pixel unit is at the first group of gate lines 44, one electrode (not labeled) of the pixel capacitor 49 is connected to the pixel electrode 48, and the other electrode (not labeled) of the pixel capacitor 49 is electrically connected to the first region 341 of the common electrode layer 34. When the pixel unit is at the second group of gate lines 44, one electrode (not labeled) of the pixel capacitor 49 is connected to the pixel electrode 48, and the other electrode (not labeled) of the pixel capacitor 49 is electrically connected to the second region 343 of the common electrode layer 34.

Figure 3:
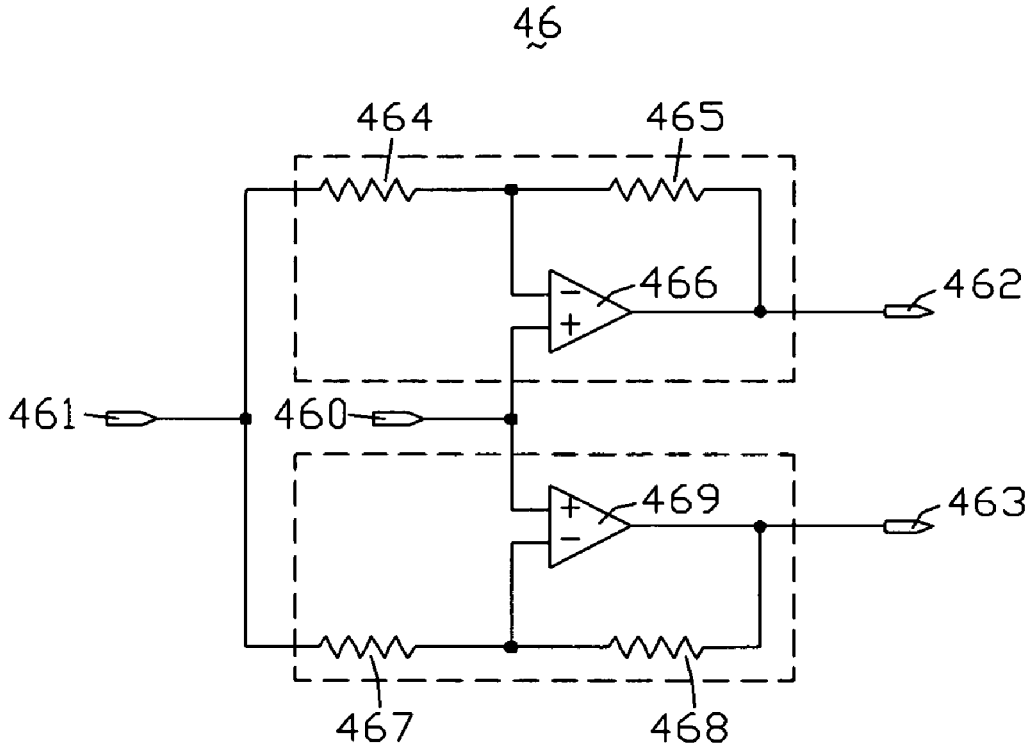
FIG. 3 is a circuit diagram of the common voltage generator of FIG. 2.

Referring also to FIG. 3, this is a circuit diagram of the common voltage generator 46. The common voltage generator 46 further includes a second input terminal 460, a first feedback unit (not labeled), and a second feedback unit (not labeled). The first feedback unit includes a first resistor 464, a second resistor 465, and a first comparator 466. A negative input terminal of the first comparator 466 is connected to the first input terminal 461 via the first resistor 464. A positive input terminal of the first comparator 466 is connected to the second input terminal 460. An output terminal of the first comparator 466 is connected to the first output terminal 462 of the common voltage generator 46. The second resistor 465 is connected between the negative input terminal and the output terminal of the first comparator 466.

The second feedback unit includes a third resistor 467, a fourth resistor 468, and a second comparator 469. A negative input terminal of the second comparator 469 is connected to the first input terminal 461 via the third resistor 467. A positive input terminal of the second comparator 469 is connected to the second input terminal 460. An output terminal of the second comparator 469 is connected to the second output terminal 463 of the common voltage generator 46. The fourth resistor 465 is connected between the negative input terminal and the output terminal of the second comparator 469. In the present embodiment, the first, second, third, and fourth resistors 464, 465, 467, 468 are adjustable.

In operation, a reference voltage is applied to the second input terminal 460 of the common voltage generator 46. The gate driver 42 applies gate signals to the gate lines 44. Thereby, the corresponding TFTs 47 connected to the gate lines 44 are turned on. The data driver 41 applies data signals to the data lines 43. The data signals are transmitted to the pixel electrodes 48 via the turned-on TFTs 47. Simultaneously, the data signals applied to the data lines 43 generate an influence signal at the coupling line 45 via the coupling capacitors. The influence signal is transmitted to the first input terminal 461 of the common voltage generator 46. The influence signal is applied to the negative input terminal of the first comparator 466 via the first resistance 464. If the voltage level of the influence signal is less than that of the reference voltage, the voltage output by the first comparator 466 is increased. As a result, the common voltage applied to the first region 341 of the common electrode layer 34 is increased. Conversely, if the voltage level of the influence signal is greater than that of the reference voltage, the voltage output by the first comparator 466 is decreased. As a result, the common voltage applied to the first region 341 of the common electrode layer 34 is decreased.

Similarly, the influence signal is applied to the negative input terminal of the second comparator 469 via the third resistance 467. If the voltage level of the influence signal is lower than that of the reference voltage, the voltage output by the second comparator 469 is increased. As a result, the common voltage applied to the second region 343 of the common electrode layer 34 is increased. Conversely, if the voltage level of the influence signal is greater than that of the reference voltage, the voltage output by the second comparator 469 is decreased. As a result, the common voltage applied to the second region 343 of the common electrode layer 34 is decreased.

As detailed above, the drive circuit 40 of the LCD 30 includes the coupling line 45 and the common voltage generator 46. The data signals applied to the data lines 43 generate a coupling signal at the coupling line 45. According to the coupling signal, the common voltage generator 46 adjusts common voltages applied to the common electrode layer 46. As a result, any crosstalk that may occur between the data lines 43 is suppressed or even eliminated altogether.

Furthermore, in the present embodiment, the first, second, third, and fourth resistors 464, 465, 467, 468 are adjustable resistors. By adjusting the resistances of the first, second, third, and fourth resistors 464, 465, 467, 468, the common electrode generator 46 can apply two different common voltages to the first and second regions 341, 343 of the common electrode layer 34. As a result, a difference in the common voltage between the first and second regions 341, 343, caused by the resistance of the common electrode layer 34, is reduced.

Figure 4:
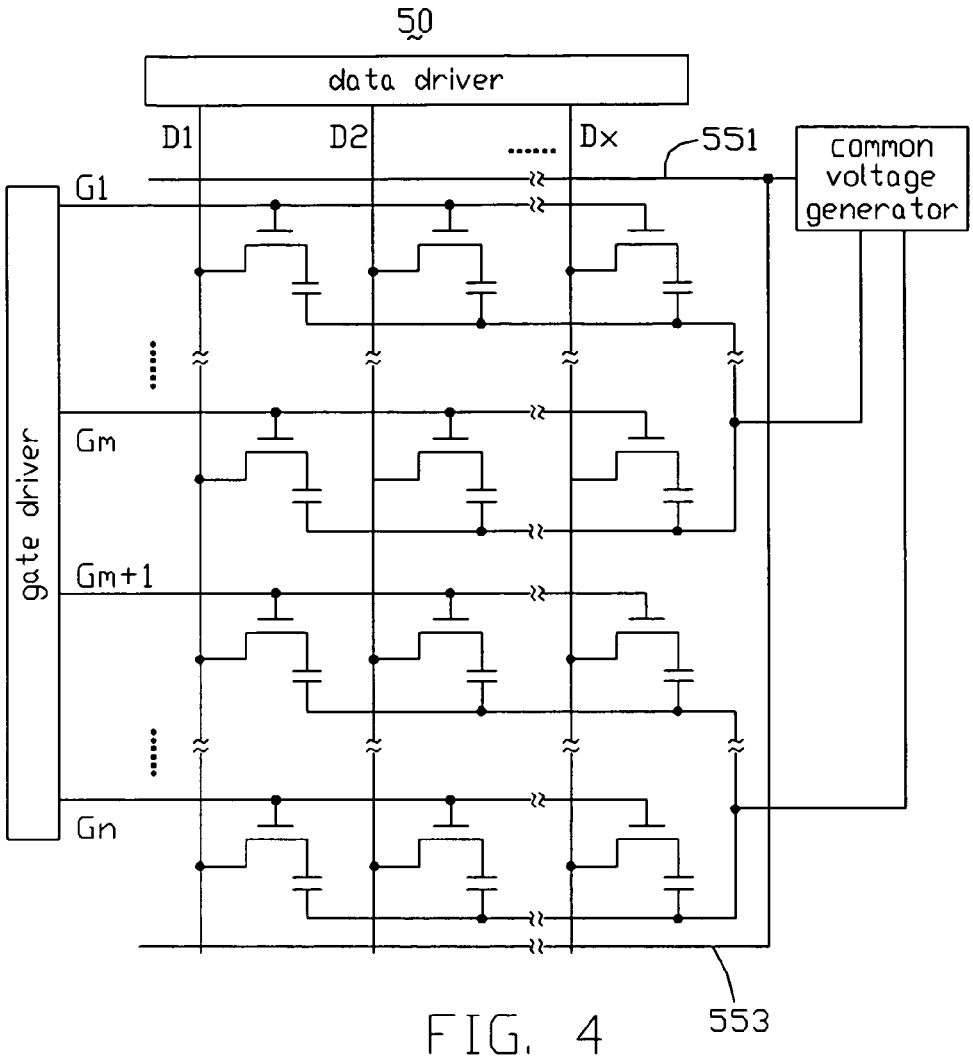
FIG. 4 is an abbreviated diagram of certain components of a drive circuit of a liquid crystal display according to a second embodiment of the present invention.

FIG. 4 is a schematic, abbreviated diagram of certain components of a drive circuit 50 of an LCD according to a second embodiment of the present invention. The drive circuit 50 has a structure similar to that of the drive circuit 40. However, the drive circuit 50 includes a first coupling line 551 and a second coupling line 553. The first and second coupling lines 551, 553 are located at two opposite sides of a TFT substrate (not shown), and are orthogonal to data lines (not labeled). Gate lines (not labeled) of the drive circuit 50 are located at the TFT substrate, between the first and second coupling lines 551, 553. One terminal of the first coupling line 551 is grounded, and the other terminal of the first coupling line 551 is connected to an input terminal (not labeled) of a common voltage generator (not labeled). One terminal of the second coupling line 553 is grounded, and the other terminal of the second coupling line 553 is connected to the input terminal of the common voltage generator.

By using the first and second coupling lines 551, 553, an influence signal generated by data signals is more precise. Therefore, the common voltage generator can precisely adjust the common voltage according to the influence signal.

Figure 5:
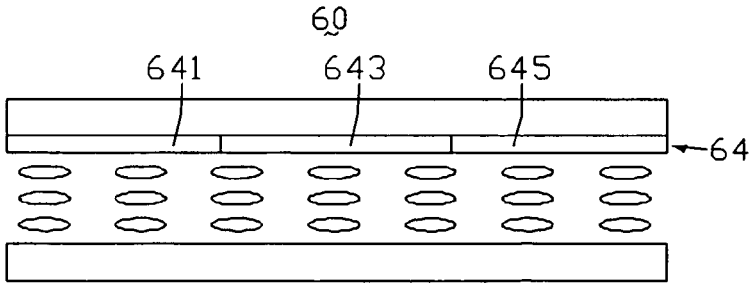
FIG. 5 is a side cross-sectional view of certain components of a liquid crystal display according to a third embodiment of the present invention, the liquid crystal display including a drive circuit (not visible).

FIG. 5 is a schematic, side cross-sectional view of certain components of an LCD 60 according to a third embodiment of the present invention. The LCD 60 has a structure similar to that of the LCD 30. However, a common electrode layer 64 is divided into a first region 641, a second region 643, and a third region 645.

Figure 6:
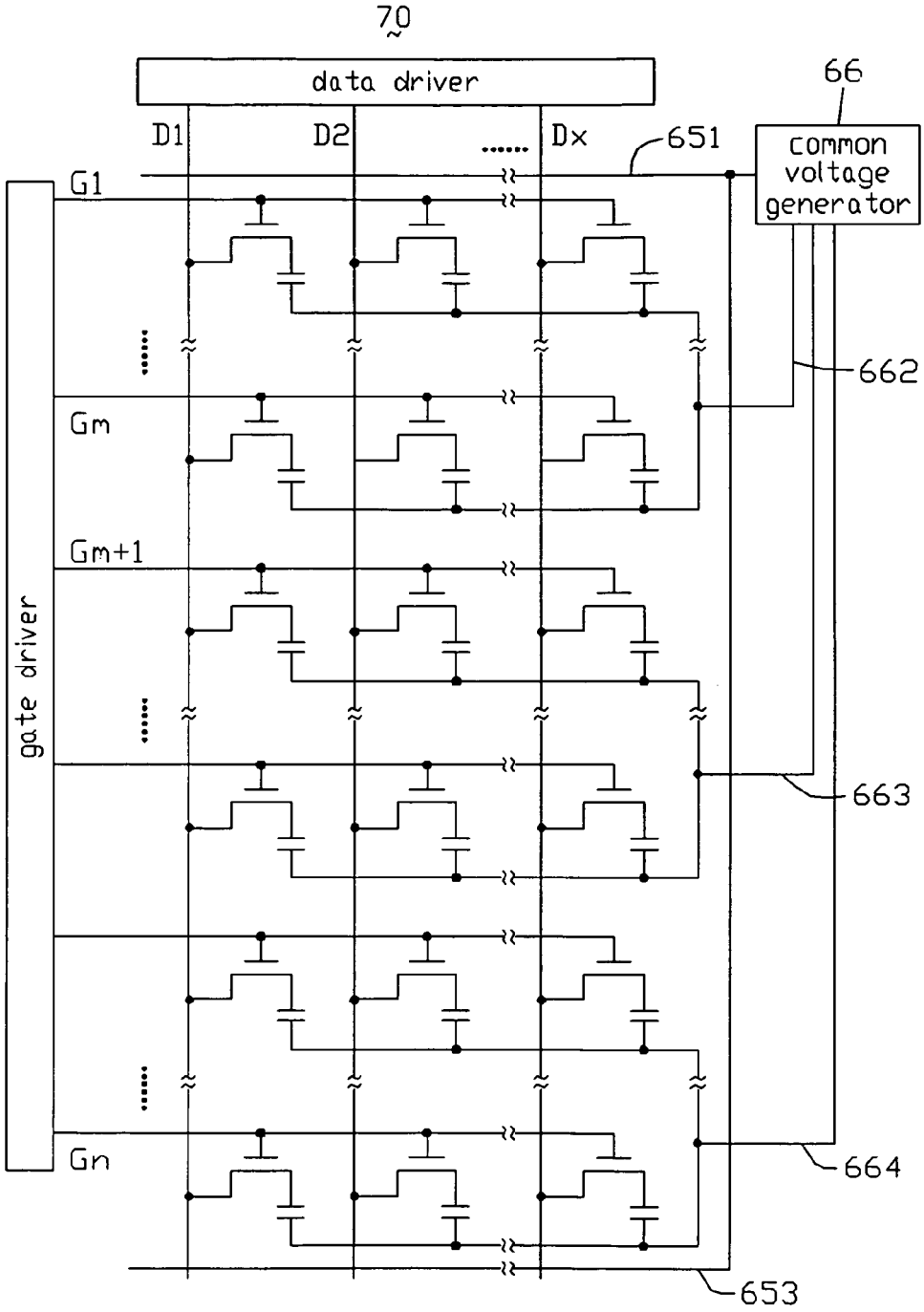
FIG. 6 is an abbreviated diagram of certain components of the drive circuit of FIG. 5, the drive circuit including a common voltage generator.

Referring also to FIG. 6, this is a schematic, abbreviated diagram of certain components of a drive circuit 70 of the LCD 60. The drive circuit 70 has a structure similar to that of the drive circuit 40. However, a common voltage generator 66 includes an input terminal (not labeled), a first output terminal 662, a second output terminal 663, and a third output terminal 664. The first, second, and third output terminals 662, 663, 664 are respectively connected to the first, second, and third regions 641, 643, 645.

The drive circuit 70 includes a first coupling line 651 and a second coupling line 653. The first and second coupling lines 651, 653 are located at two opposite sides of a TFT substrate (not shown), and are orthogonal to data lines (not labeled). One terminal of the first coupling line 651 is grounded, and the other terminal of the first coupling line 651 is connected to an input terminal (not labeled) of a common voltage generator 66. One terminal of the second coupling line 653 is grounded, and the other terminal of the second coupling line 653 is connected to the input terminal of the common voltage generator 66.

Gate lines (not labeled) of the drive circuit 70 are located at the TFT substrate, between the first and second coupling lines 651, 653. The gate lines are divided into a first group (not labeled), a second group (not labeled), and a third group (not labeled), corresponding to first, second, and third regions 641, 643, 645, respectively. Electrodes of pixel capacitors (not labeled) of pixel units (not labeled) located at the first, second, and third gate line groups are electrically connected to the corresponding first, second, and third regions of the common electrode layer 64.

Figure 7:
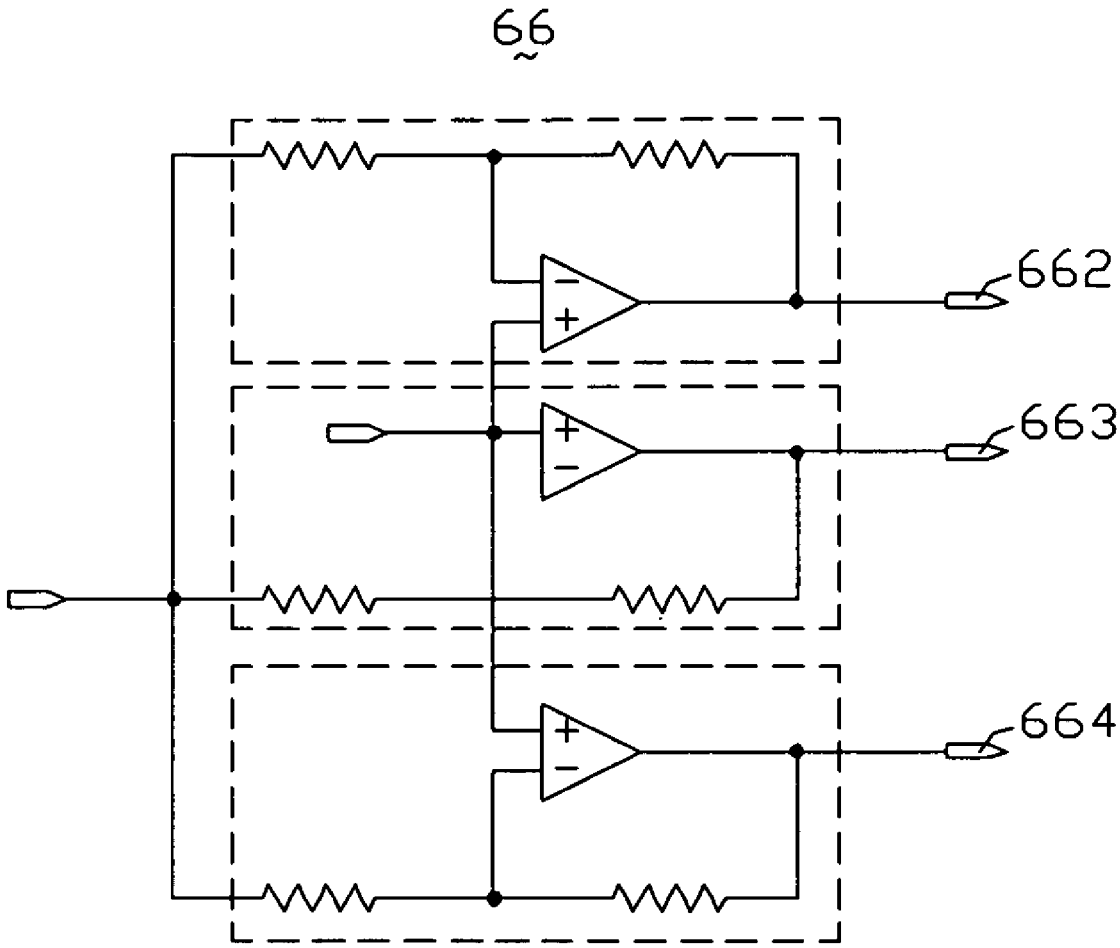
FIG. 7 is a circuit diagram of the common voltage generator of FIG. 6.
Figure 8:
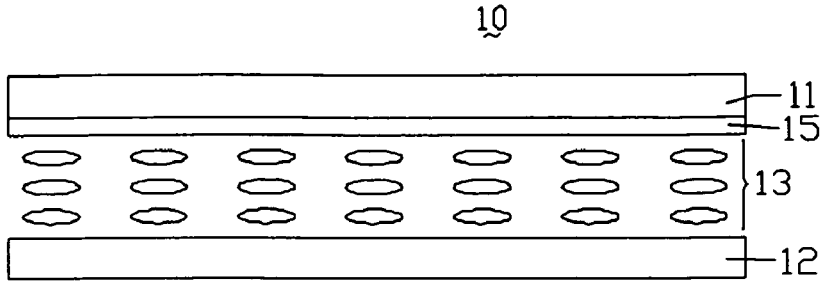
FIG. 8 (RELATED ART)
FIG. 8 is a side cross-sectional view of certain components of a conventional liquid crystal display, the liquid crystal display including a drive circuit (not visible).
Figure 9:
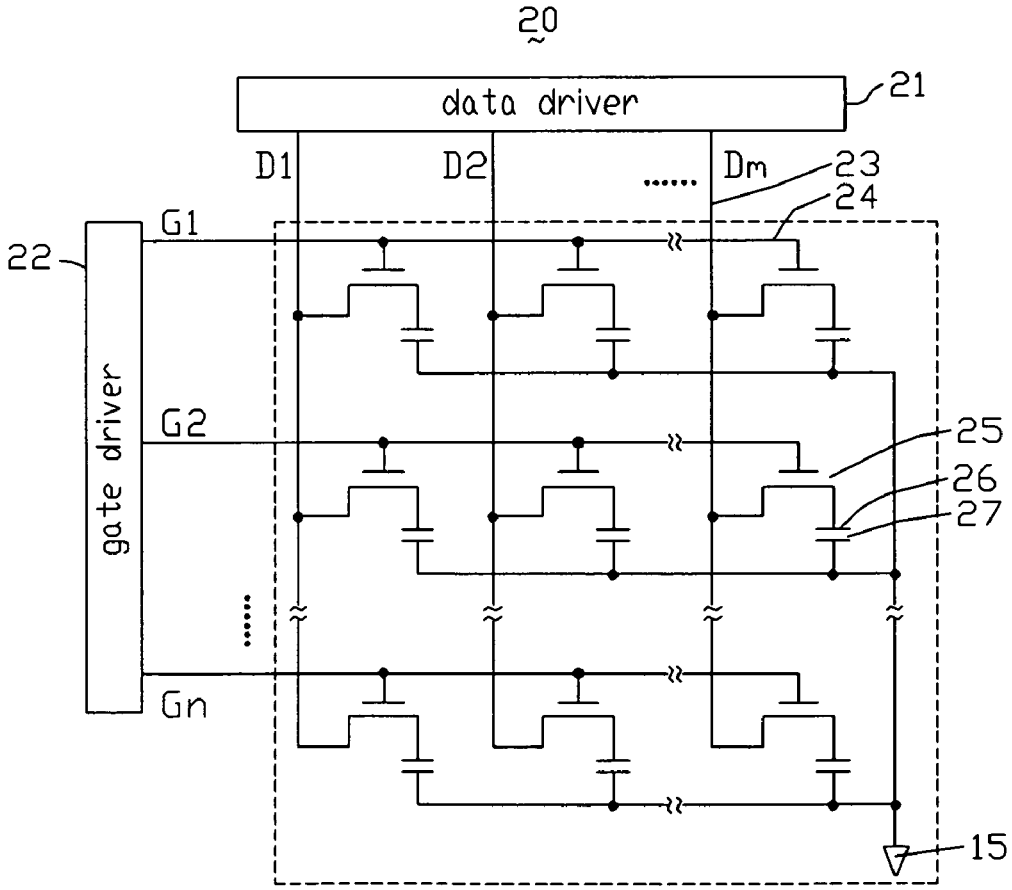
FIG. 9 (RELATED ART)
FIG. 9 is an abbreviated diagram of certain components of the drive circuit of FIG. 8, the drive circuit including a gate driver and a data driver.
Figure 10:
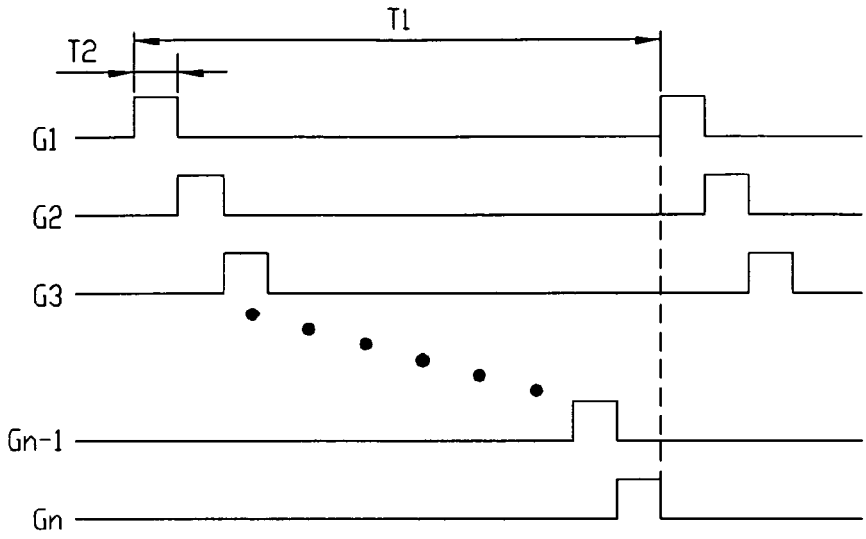
FIG. 10 (RELATED ART)
FIG. 10 is an abbreviated timing chart illustrating operation of the gate driver of FIG. 9.
Figure 11:
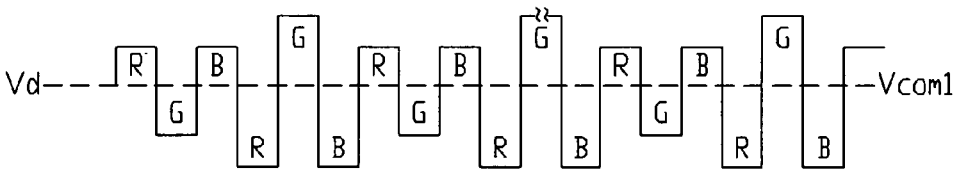
FIG. 11 (RELATED ART)
FIG. 11 is an abbreviated timing chart illustrating operation of the data driver of FIG. 9, showing data voltages relative to a common voltage of the liquid crystal display.
Figure 12:
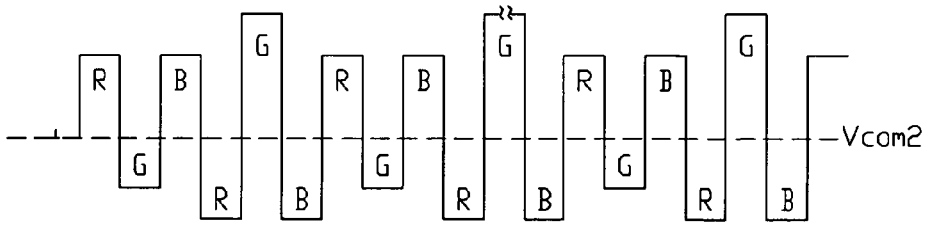
FIG. 12 (RELATED ART)
FIG. 12 is similar to FIG. 10, but showing the common voltage of the liquid crystal display pulled down by parasitic capacitance.

Referring also to FIG. 7, this is a circuit diagram of the common voltage generator 66. The common voltage generator 66 includes three feedback units (not labeled). Output terminals of the three feedback units are respectively connected to the first, second, and third output terminals 662, 663, 664 of the common voltage generator 66.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size, and arrangement of parts within the principles of the invention to the full extent indicated by the broad general meaning of the terms in which the appended claims are expressed.

What is claimed is:

1. A liquid crystal display, comprising:

a plurality of data lines parallel to each other;

a data driver configured for driving the data lines and arranged at one side of the plurality of data lines;

a plurality of pixel units;

a first coupling line crossing the data lines without connecting to the pixel units thereby defining a plurality of coupling capacitors between the first coupling line and the data lines;

a second coupling line crossing the data lines without connecting to the pixel units thereby defining another plurality of coupling capacitors between the second coupling line and the data lines; a position where the second coupling line is disposed being farther from the data driver than a position where the first coupling line is disposed;

a common electrode layer; and a common voltage generator configured for applying at least one common voltage to the common electrode layer, and connected to the first and second coupling lines;

wherein the common electrode layer is capable of receiving the at least one common voltage; the data driver is configured to apply a plurality of data signals to the data lines, the first and second coupling lines are capable of coupling the data signals on the data lines thereby generating an influence signal at the first and second coupling lines, and the common voltage generator receives the influence signal and then adjusts the at least one common voltage applied to the common electrode layer according to the influence signal.

2. The liquid crystal display of claim 1, further comprising a thin film transistor substrate, the data lines and the first and second coupling lines being located on the thin film transistor substrate.

3. The liquid crystal display of claim 2, further comprising a plurality of gate lines parallel to each other and orthogonal to the data lines, and the first and second coupling lines being parallel to the gate lines, wherein the data driver is located on the thin film transistor substrate, and the first coupling line is located between the data driver and the plurality of gate lines.

4. The liquid crystal display of claim 3, wherein the plurality of gate lines is located between the first and second coupling lines.

5. The liquid crystal display of claim 3, wherein the common electrode layer defines a plurality of regions, the number of the at least one common voltage generated by the common voltage generator is equivalent to the number of the regions, and the regions receive corresponding common voltages respectively.

6. The liquid crystal display of claim 5, wherein the common electrode generator comprises a plurality of feedback units, the feedback units are electrically connected to the regions of the common electrode layer respectively, and the feedback units respectively adjust the corresponding common voltages applied to the regions according to the influence signal.

7. The liquid crystal display of claim 6, wherein each of the feedback units comprises a comparator, a first resistor, and a second resistor, the comparator comprising a positive input terminal, a negative input terminal, and an output terminal, the positive input terminal capable of receiving a reference voltage, the negative input terminal receiving the influence signal via the first resistor, the output terminal being electrically connected to the corresponding region of the common electrode layer, the second resistor being connected between the negative input terminal and the output terminal.

8. The liquid crystal display of claim 5, wherein each pixel unit comprising a thin film transistor, a pixel electrode, and a pixel capacitor, a gate electrode of the thin film transistor being connected to a corresponding gate line, a source electrode of the thin film transistor being connected to a corresponding data line, a drain electrode of the thin film transistor being connected to the pixel electrode.

9. The liquid crystal display of claim 8, wherein one electrode of the pixel capacitor is connected to the pixel electrode, and the other electrode of the pixel capacitor is electrically connected to a corresponding region of the common electrode layer.

10. The liquid crystal display of claim 1, wherein one terminal of the first coupling line and one terminal of the second coupling line are grounded and the other terminal of the first coupling line and the other terminal of the second coupling line are connected to a same input terminal of the common voltage generator.

11. A method for driving a liquid crystal display, the liquid crystal display comprising a plurality of data lines parallel to each other, a plurality of pixel units and a data driver capable of generating a plurality of data signals to the data lines, the method comprising:

providing a first coupling line crossing the data lines without connecting to the pixel units thereby defining a plurality of coupling capacitors between the first coupling line and the data lines;

simultaneously providing a second coupling line crossing the data lines without connecting to the pixel units thereby defining another plurality of coupling capacitors between the second coupling line and the data lines, wherein a position where the second coupling line is applied is farther from the data driver than a position where the first coupling line is applied;

applying a plurality of data signals to data lines of the liquid crystal display;

generating an influence signal according to the data signals at the first and second coupling lines; and adjusting common voltages of the liquid crystal display according to the influence signal via a common voltage generator.

12. The method of claim 11, wherein the common voltage generator comprises a plurality of feedback units, the liquid crystal display comprises a common electrode layer including a plurality of regions, and the feedback units respectively adjust the common voltages of the regions according to the influence signal.

13. The method of claim 12, wherein each feedback unit comprises a comparator, and the comparator receives the influence signal and a reference voltage and adjusts a common voltage of the corresponding region of the common electrode layer of the liquid crystal display.

14. The method of claim 13, wherein if the voltage level of the influence signal is greater than that of the reference voltage, the common voltage output by the comparator is decreased.

15. The method of claim 13, wherein if the voltage level of the influence signal is lower than that of the reference voltage, the common voltage output by the comparator is increased.

16. A liquid crystal display, comprising:

a plurality of data lines parallel to each other a plurality of gate lines parallel to each other and crossing the data lines;

a plurality of pixel units;

a data driver configured for driving the data lines, ends of the plurality of data lines that connect to the data driver defining a plurality of inputting ends of the data lines;

two coupling lines crossing the data lines without connecting to the pixel units thereby defining a plurality of coupling capacitors between each coupling line and the data lines, wherein one of the two coupling lines is farther from the inputting ends of the data lines than the other of the two coupling lines;

a common electrode layer; and a common voltage generator configured for applying at least one common voltage to the common electrode layer, and connected to the two coupling lines;

wherein the common electrode layer is capable of receiving the at least one common voltage;

the data driver is configured to apply a plurality of data signals to the data lines, the two coupling lines are capable of coupling the data signals on the data lines thereby generating an influence signal at the two coupling lines, and the common voltage generator receives the influence signal and then adjusts the at least one common voltage applied to the common electrode layer according to the influence signal.

17. The liquid crystal display of claim 16, wherein the plurality of gate lines are located between the two coupling lines.

18. The liquid crystal display of claim 17, wherein one terminal of each coupling line is grounded and the other terminal of each coupling line is connected to a same input terminal of the common voltage generator.

19. The liquid crystal display of claim 16, wherein the common electrode layer defines a plurality of regions, the number of the at least one common voltage generated by the common voltage generator is equivalent to the number of the regions, and the regions receive corresponding common voltages respectively.

20. The liquid crystal display of claim 19, wherein the common electrode generator comprises a plurality of feedback units, the feedback units are electrically connected to the regions of the common electrode layer respectively, and the feedback units respectively adjust the corresponding common voltages applied to the regions according to the influence signal.

* * * * *